US005472296A

United States Patent [19]

von Allmen et al.

[11] Patent Number: 5,472,296

[45] Date of Patent: Dec. 5, 1995

[54] CORROSION PROTECTED SUPPORT ELEMENT FOR A SOIL ANCHOR OR A ROCK ANCHOR, A PRESSURE PILE OR THE LIKE

[75] Inventors: Hans-Peter von Allmen, Bäretswil, Switzerland; Thomas Herbst, Wessling; Reinhard Klôckner, Munich, both of Germany

[73] Assignee: Dyckerhoff & Widmann Aktiengesellschaft, Munich, Germany

[21] Appl. No.: 108,817

[22] Filed: Aug. 18, 1993

[30] Foreign Application Priority Data

Aug. 20, 1992 [CH] Switzerland ..... 2589/92
May 25, 1993 [EP] European Pat. Off. ..... 93108410

[51] Int. Cl.[6] ..... E02D 5/22

[52] U.S. Cl. ..... 405/233; 405/239; 405/244; 405/259.5

[58] Field of Search ..... 411/82, 258; 405/259.1, 405/259.5, 232, 233, 239, 244, 256, 257

[56] References Cited

U.S. PATENT DOCUMENTS

| | | | |
|---|---|---|---|
| 3,114,245 | 12/1963 | Jennings et al. | 405/244 |
| 3,496,729 | 2/1970 | Bleuger | 405/239 X |
| 4,112,637 | 9/1978 | Herbst | 405/259.1 X |
| 4,386,876 | 5/1983 | Dupeuble | 405/259.5 |
| 4,411,557 | 10/1983 | Booth | 405/239 X |
| 4,440,526 | 4/1984 | Koppers et al. | 405/259.5 |
| 4,648,753 | 3/1987 | Stephan | 405/259.5 |
| 4,840,524 | 6/1989 | Bisping et al. | 411/82 |
| 4,971,493 | 11/1990 | Herbst et al. | 405/259.5 X |
| 5,049,015 | 9/1991 | Sawaide et al. | 411/82 |
| 5,104,266 | 4/1992 | Daryoush et al. | 405/259.5 |
| 5,154,540 | 10/1992 | Barley | 405/259.5 |

FOREIGN PATENT DOCUMENTS

| | | | |
|---|---|---|---|
| 2444755 | 8/1980 | France | 405/244 |
| 2302412 | 7/1974 | Germany | 405/259.5 |
| 2550954 | 3/1978 | Germany | 411/82 |
| 1145914 | 3/1969 | United Kingdom | 405/233 |

*Primary Examiner*—John A. Ricci
*Attorney, Agent, or Firm*—Friedrich Kueffner

[57] ABSTRACT

A corrosion-protected support element for a soil anchor or a rock anchor or a pressure pile includes a support member which is provided with a tubular casing. The hollow space between the support member and the casing is filled out by a hardening material, for example, cement mortar. The tubular casing is a plastics material tube, for example, of PE, which extends over the entire length of the support member. The plastics material tube has the same cross-section over its entire length. In the region of force-transmission between the support member and the bore hole in which the support element is placed, the plastics material tube is deformed at spaced-apart locations to deviating cross-sections having different transverse extensions.

15 Claims, 4 Drawing Sheets

CORROSION PROTECTED SUPPORT ELEMENT FOR A SOIL ANCHOR OR A ROCK ANCHOR, A PRESSURE PILE OR THE LIKE

BACKGROUND OF THE INVENTION

1. Field of the Invention

The present invention relates to a corrosion-protected support element for a soil anchor, a rock anchor, a pressure pile or the like. The support element includes a support member composed of one or more individual elements. For providing protection against corrosion, the support member is at least over a portion of its length surrounded by a tubular casing or sheathing. The hollow space between the support member and the casing is filled out with a hardening material, for example, cement mortar. The support element is mounted in a bore hole and the support member can be placed in force-transmitting connection with the ground through a force transmitting region extending over at least a portion of its length by filling the bore hole with hardening material, for example, cement mortar.

2. Description of the Related Art

Structural members which extend into the ground, such as, soil and rock anchors which are subjected essentially to tensile forces, or pressure piles which are subjected to compressive forces, are used for introducing loads, for example, from structures, into deeper ground layers. Consequently, such structural members have over the length thereof at least one portion along which the tensile or compressive forces acting in the structural member are transmitted from the structural member into the ground. In the case of tension rods, this force-transmitting length is the so-called anchoring length in the depth of the bore hole. The area of the free steel length is adjacent the anchoring length and extends toward the opening of the bore hole. Along this free steel length, the tension member is freely extendable. In the case of pressure piles, the transmission of the compressive forces takes place essentially along the entire length of the pressure member. For transmitting these forces, the support member is usually placed in the respective area directly in bonding connection with a hardening material, for example, cement mortar which is filled into the remaining space in the bore hole. This hardening material ensures the connection with the bore hole wall and, thus, with the ground.

In structural members of the above-described type, which are not only mounted temporarily, such as, for temporarily securing an excavation cleading, but also permanently, the corrosion protection of a support member consisting of steel plays an important role. In addition to the admission of water and oxygen dissolved in the water to the steel surface and any occurring stray currents, the main cause of corrosion is the formation of macroelements. Accordingly, the most important corrosion protection measure is the provision of a casing in the form of a plastics material tube surrounding the steel support member over its entire length, wherein the plastics material tube has a high diffusion resistance and electric volume resistance. This plastics material tube forms the first barrier which also ensures the electrical separation between steel support member and ground and, thus, facilitates monitoring of the corrosion protection measure by means of an electrical resistance measurement. By pressing in cement mortar within and outside of the plastics material tube, an alkaline environment is produced as the second barrier against corrosion.

In a known soil anchor for permanent anchoring systems, the casing is composed at least in the area of the anchoring length of a ribbed jacket tube of plastics material. An additional plastics material tube having a smooth surface may be slid over the adjacent portion of the free steel length for maintaining the longitudinal mobility of the support member (German Patent 17 59 561). If the longitudinal mobility of the support member is ensured in a different manner, for example, by using so-called grease strands for the tension member, the ribbed casing tube may also be connected to a smooth casing tube at the transition from the anchoring length to the free steel length (German Company Brochure "DYWIDAG—Bericht", No. 11, 1982, pages 12–14). In all cases, the ribbing of the casing tube in the area of the anchoring length has the purpose of transmitting the forces from the support member through the pressing body in the ground past the discontinuity formed by the tubes. Analogously, this is also true for pressure piles (German Company Brochure "DYWIDAG GEWI—Pfahl", DYWIDAG-SYSTEMS INTERNATIONAL GmbH, D-8000 München, 1987).

Aside from the fact that a joint of casing tubes at the transition from the free steel length to the anchoring length represents a weak point, the ribbed plastics material tubes which have been available in the past have been found to be susceptible to mechanical damage, particularly when the anchor element is introduced into the bore hole. This is because ribbed tubes have a smaller wall thickness than tubes having a smooth wall because of the manner in which ribbed tubes are manufactured. In addition, when the pressure occurring during pressing in material and elongations or displacements occurring during tensioning of tension rods frequently negatively affect the tightness of the casing tube and the electric volume resistance thereof.

SUMMARY OF THE INVENTION

Therefore, it is the primary object of the present invention, in a support element of the above-described type, to provide a possibility of ensuring the corrosion protection even and especially in the area of the force transmission over long periods of time and with certainty, without impairing the force transmission from the support member to the ground and taking into consideration the discontinuity resulting from the tubes.

In accordance with the present invention, the tubular casing is composed of a tube of plastics material, for example, PE, which extends over the entire length of the support member. The tube has the same transverse cross-section over the entire length thereof. At least in the areas of transmission of forces from the support member to the ground, the original uniform cross-section of the tube is deformed at spaced-apart locations to deviating cross sections having different transverse extensions.

The present invention is based on the finding that a plastics material tube which has a smooth wall and has the appropriate thickness and is less susceptible to damage as a result, as it is usually arranged in the area of the free steel length, can also be provided in the area of the force transmission if the tube is provided at certain locations with a cross section which differs from the original, usually circular cross section located at spaced-apart locations and having different transverse extensions. When longitudinal forces occur, the deviating cross sections result in wedging of the deformed support member in the hardening material which fills out the bore hole and, thus, lead to a reliable force transmission to the pressing body. The distances between the deformed locations from each other and the type and dimensions of the deformations are determined in dependence on the quality of the soil and the load to be transmitted per unit of length. The deformations can be produced in a simple manner after the support element has been assembled by applying transverse pressure to the tube which, for example, in the case of an originally circular cross section, results at the respective locations in an approximately oval cross section. When this subsequent deformation is carried out, the support member in the interior itself forms an inner limitation for the extent of the deformation.

Since plastics material tubes develop restoring forces when outside forces are applied, wherein the restoring forces have the tendency to reverse the produced deformations, it must be ensured that these deformations are maintained at least until the hardening material for forming the pressing body has been introduced and has hardened. In accordance with the present invention, this is achieved by providing, at least at the locations at which the deformations are to be produced, plastically permanently deformable structural components which are deformed simultaneously with the plastics material tube and which, because of the material properties thereof, not only themselves maintain the shape produced by the deformation, but also prevent the plastics material tube from resuming its original cross-sectional shape.

The plastically permanently deformable structural components may either be components arranged continuously within the plastics material tube, such as, a spiral of steel wire or steel band or strip, which may even be embedded in the tube wall, as well as a metal tube provided with profilings, or the components may be rings of steel arranged outside of the plastics material tube and only at the locations to be deformed, wherein the rings are deformed together with the plastics material tube. The structural components arranged within the plastics material tube have the advantage that the outer surface of the plastics material tube remains smooth, i.e., without locations of unevenness, so that the support element can be easily introduced into a bore hole. When the structural components are arranged within the plastics material tube, it must be ensured that the remaining hollow space can be filled out completely with hardening material. This is easily possible in the case of a spiral. In the case of a continuous metal tube, this can be achieved by a profiling and openings in the tube wall. Structural components arranged within the plastics material tube provide the additional advantage that a predetermined distance is maintained at all times between the support member and the tube wall.

The various features of novelty which characterize the invention are pointed out with particularity in the claims annexed to and forming a part of the disclosure. For a better understanding of the invention, its operating advantages, specific objects attained by its use, reference should be had to the drawing and descriptive manner in which there are illustrated and described preferred embodiments of the invention.

DESCRIPTION OF THE PREFERRED EMBODIMENTS

Figure 1:
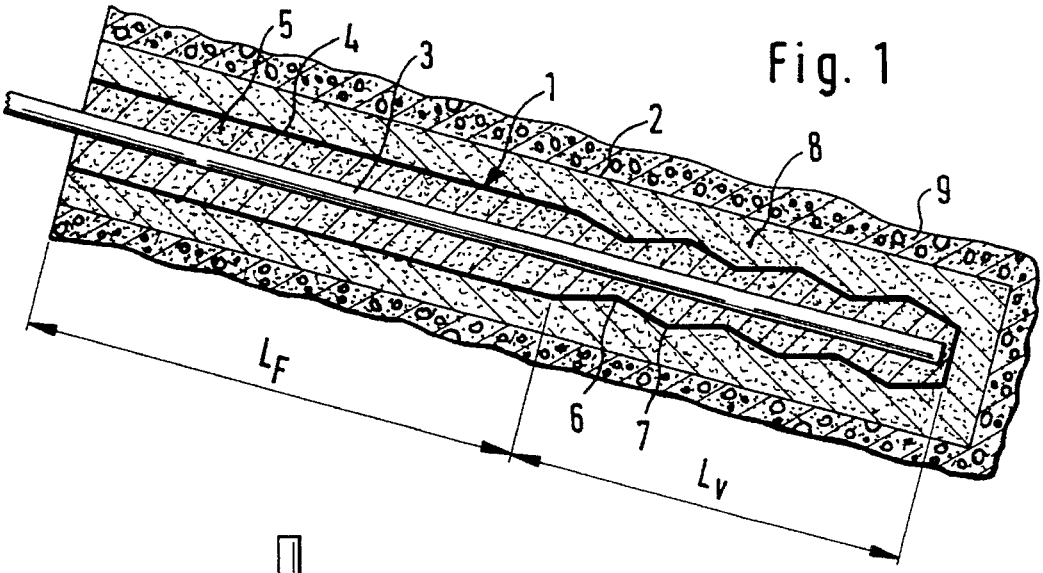
FIG. 1 is a schematic sectional view of a soil anchor with a support element in accordance with the present invention.
Figure 2:
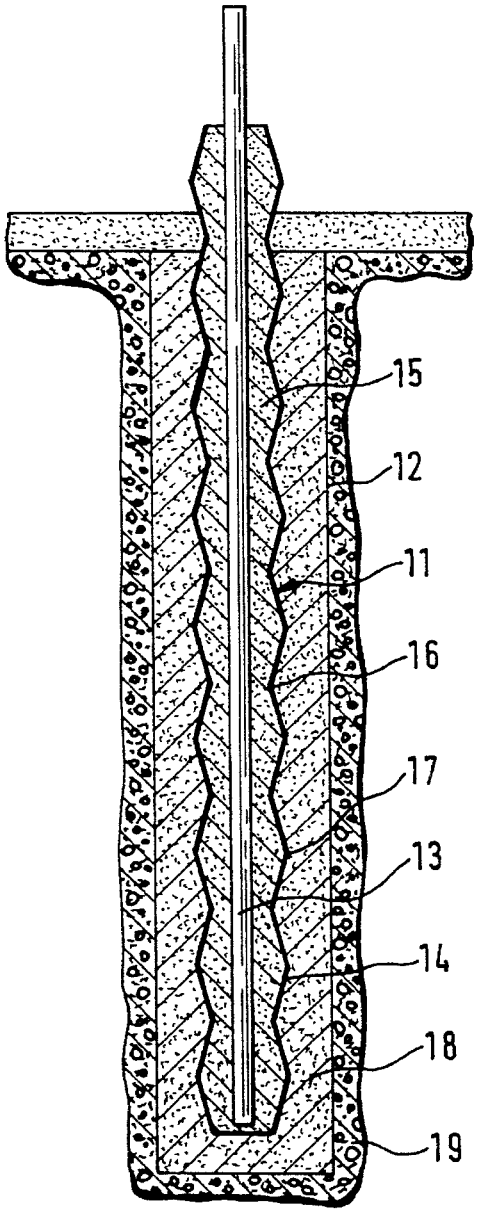
FIG. 2 is a schematic sectional view of a pressure pile with a support element in accordance with the present invention.

FIGS. 1 and 2 of the drawing schematically illustrate the significant fields of use of the support element according to the present invention. Thus, FIG. 1 of the drawing shows a soil anchor or rock anchor and FIG. 2 of the drawing shows a pressure pile.

FIG. 1 is a longitudinal sectional view of a soil anchor with a support element 1 which is inserted into a bore hole 2. The support element 1 is composed of a support member, in this case a steel tension member 3, which may be a single steel rod or a bundle of steel wires or steel wire strands and which is surrounded over its entire length L by a casing or sheathing tube 4 of plastics material. The casing tube 4 is provided with deformations of different transverse extensions over the area of the anchoring length $L_V$, wherein the deformations are partially in the form of indentations 6 and partially in the form of projections 7. The indentations 6 and the projections 7 are only schematically illustrated in the drawing. The casing tube 4 has a uniform cross-section, particularly a circular cross section, over the area of the free steel length $L_F$ adjacent the anchoring area $L_V$ and extending toward the opening of the bore hole 2. The hollow space remaining between the steel tension member 3 and the casing tube 4 is filled out by a hardening material 5, for example, cement mortar. The injection of the hollow space between steel tension member 3 and casing tube 4 can be carried out before or after the support element 1 has been placed in the bore hole 2. The hollow space still remaining in the bore hole 2 is subsequently filled out with hardening material 8, particularly cement mortar, which transmits after hardening the loads introduced through the support element 1 to the surrounding ground 9.

In a similar manner, FIG. 2 schematically shows a pressure pile. Also in this case, a support element 11 is placed in a bore hole 12. In this support element 11, the support member is composed of a steel pressure member 13, for example, a ribbed reinforcing rod and is surrounded over its entire length L by a casing tube 14. Since, in accordance with its function as a pressure member, the support element 11 transmits force to the surrounding ground over the entire length L, the casing tube 14 is also provided over its entire length with deformations of different transverse extensions. Also in this case, the transverse extensions are indicated schematically as indentations 16 and projections 17. The hollow space between the steel pressure member 13 and the casing tube 14 is filled out with hardening material 15. Also in this case, after insertion of the support element 11 into the bore hole 12, hardening material 18, particularly cement mortar, is pressed into the remaining hollow space. After hardening, the hardening material 18 transmits the introduced loads through pile end forces and wall friction to the surrounding ground 19.

Figure 3:
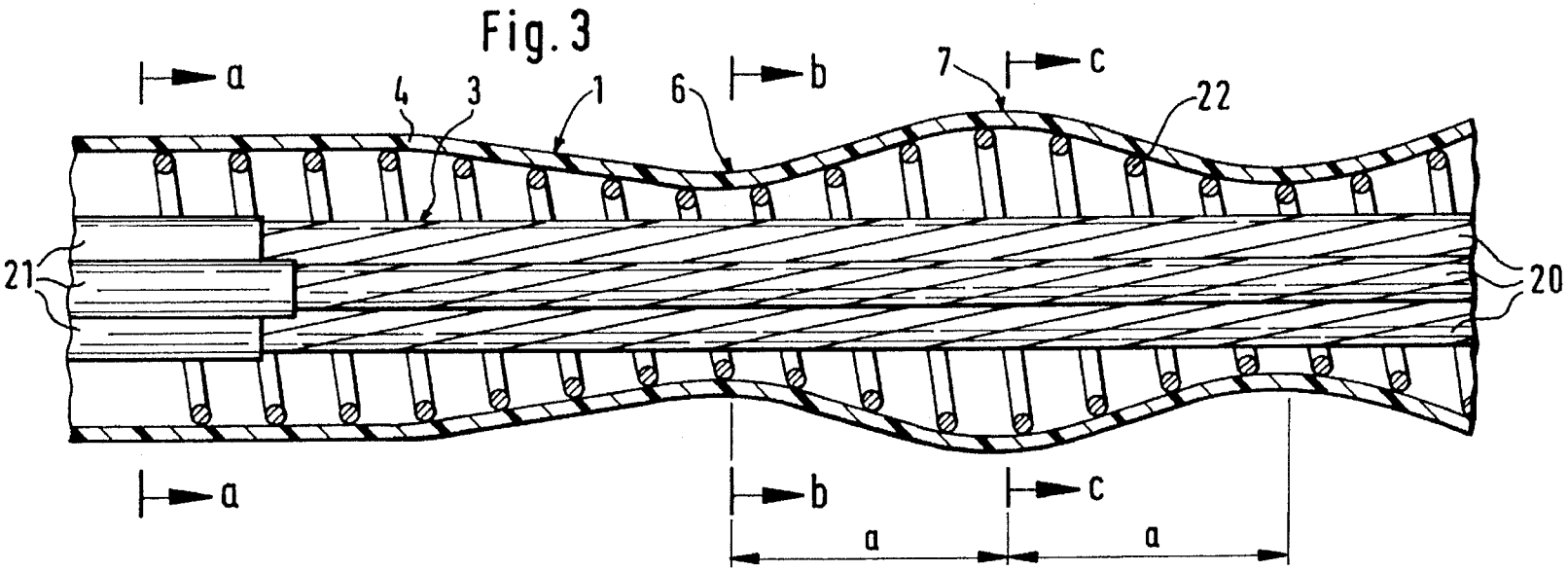
FIG. 3 is a partial longitudinal sectional view, on a larger scale, of a tension element according to the present invention.

In the embodiment of a soil anchor according to FIG. 1 illustrated in FIGS. 3 and 4 in detail and on a larger scale, the steel tension member 3 is composed of a bundle of steel wire strands 20 which, in the area of the free steel length, are conducted in their own sheathings 21 for maintaining the longitudinal mobility thereof.

Figure 4C:
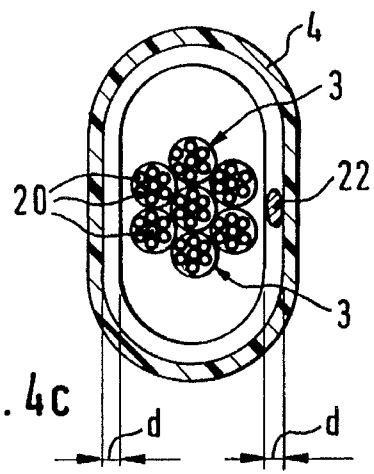
FIGS. 4*a*–4*c* are sectional views taken along sectional lines a—a, b—b, c—c, respectively, in FIG. 3.
Figure 4B:
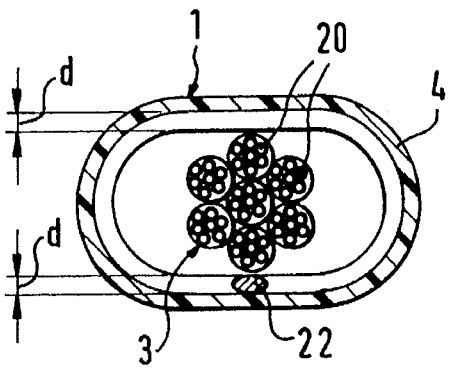
Figure 4A:
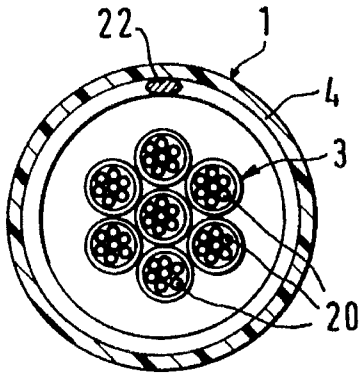

While the plastics material tube 4 surrounding the steel tension member 3 has in the area of the free steel length $L_F$ still the original circular cross-section, as shown in FIG. 4*a*, the cross-section is deformed in the area of the anchoring length $L_V$ at several locations 6 or 7 in equal spacings a therebetween into an oval cross-section, as can be seen in FIGS. 4*b* and 4*c*. The deformation must be carried out to such an extent that a secure anchoring of the support element 1 in the pressing body, not shown, is ensured. The deformation is preferably to be carried out in such a way that the smaller diameter is approximately 80 to 90% of the original circular diameter.

Figure 9D:
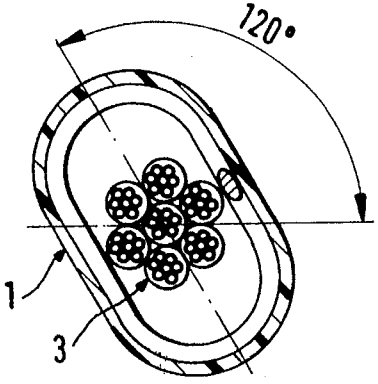
FIGS. 9*a* to 9*d* are sectional views of another embodiment of the tension member according to the present invention.
Figure 9C:
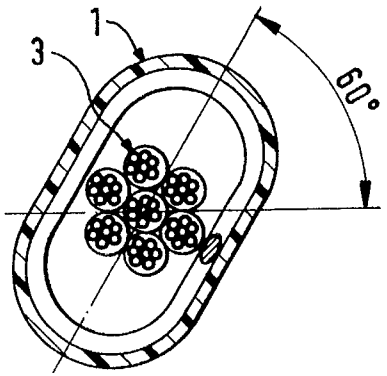
Figure 9B:
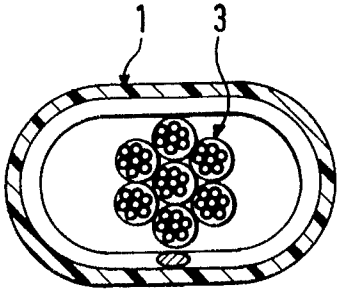
Figure 9A:
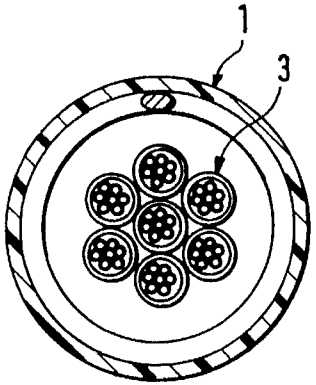

As illustrated particularly in FIGS. 4*b* and 4*c*, the arrangement of deformations is arranged in such a way that at successive locations the same cross-sectional shapes are offset by 90°. The deformations could also be offset by different angles, for example, by angles of 60° over three successive locations, as illustrated in FIGS. 9*b* to 9*d* of the drawing.

Figure 8:
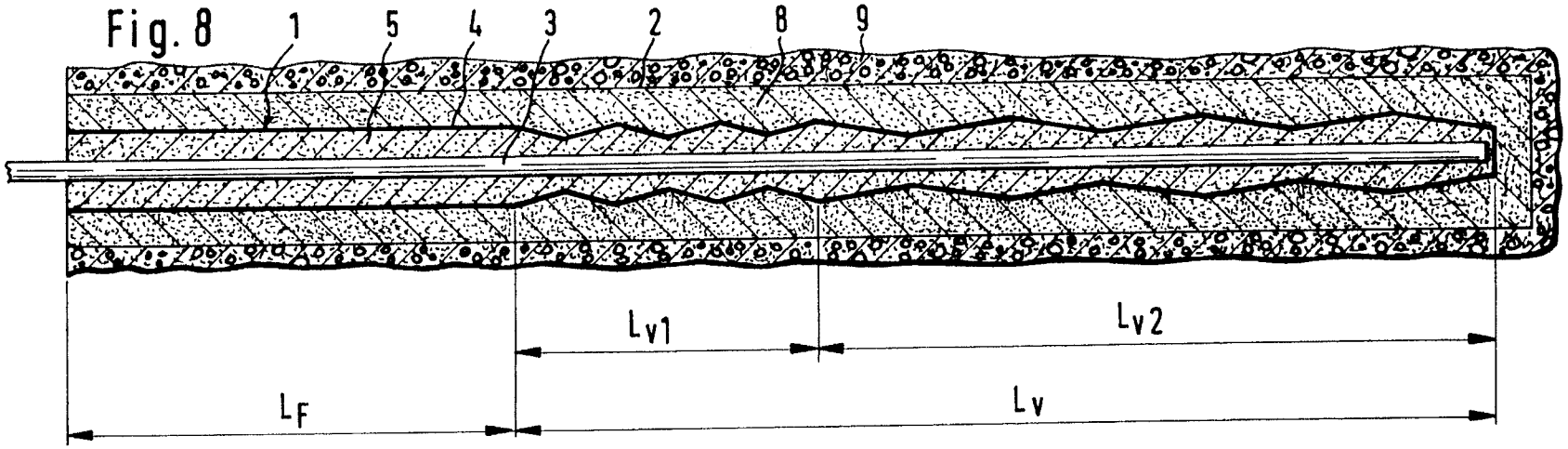
FIG. 8 is a partial longitudinal sectional view of another embodiment of the tension element according to the present invention.

The distances a between the locations of the deformations may also vary. As shown in FIG. 8, the distances between the locations of the deformations along length $L_{v1}$ are substantially smaller than the distances between the locations of the deformations along length $L_{v2}$. The distances a as well as the transverse extensions of the deformations, may be adapted to the magnitude of the forces to be transmitted. Thus, the deformations are spaced closer together in the area of high-force transmission than in the area of low-force transmission. In this embodiment, a spiral 22 of steel wire is arranged in the interior of the plastics material tube 4 in order to fix the deformations obtained by the application of a transverse pressure. Analogously, the spiral could also be of steel strip. The individual windings of the spiral 22 are deformed under the influence of an external transverse pressure in the same manner as the plastics material tube 4, but the plastic permanent deformation of the individual windings of the spiral 22 prevent the plastics material tube 4 from returning into the original circular shape as a result of elastic restoring forces. The spiral 22 simultaneously secures the distance d between the steel tension member 3.1 and the inner wall of the plastics material tube 4 which is important for reasons of minimum concrete cover, and prevents, in accordance with the principle of an encircling reinforcement, the hardening material arranged in the interior of the plastics material tube 4 from longitudinally ripping under the influence of the tensile force of the anchor.

Figure 5A:
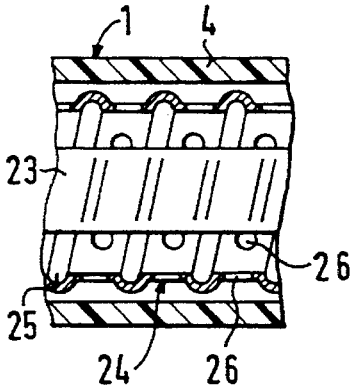
FIGS. 5*a*–5*c* to 7*a*–7*c* are longitudinal sectional views and transverse sectional views of other embodiments of the support member according to the present invention, wherein the transverse sectional views show the support member in the original and in the deformed states.
Figure 5B:
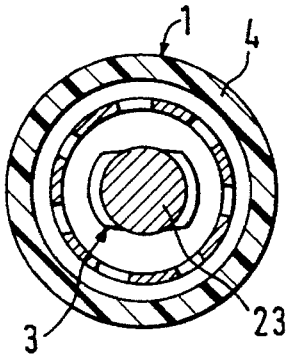
Figure 5C:
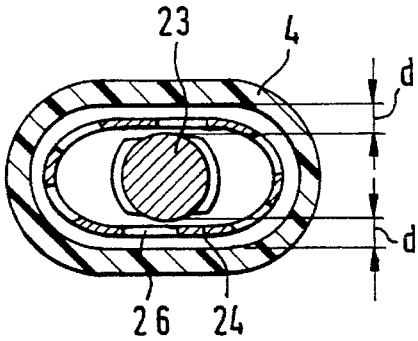
Figure 6A:
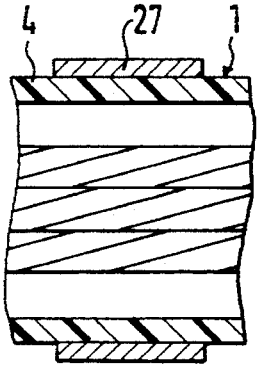
Figure 6B:
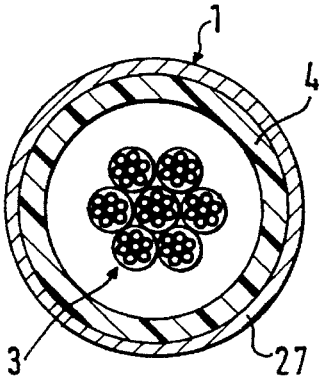
Figure 6C:
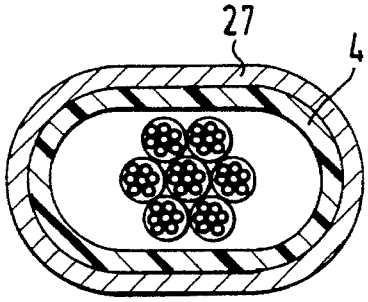
Figure 7A:
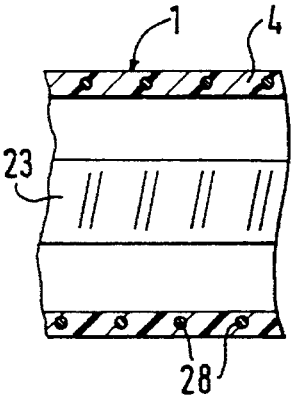
Figure 7B:
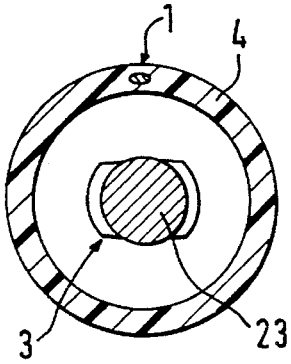
Figure 7C:
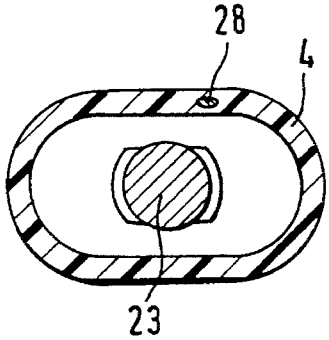

FIGS. 5*a*–5*c* to 7*a*–7*c* show additional embodiments of the structural components which can be utilized for fixing the deformations of the plastics material tube. FIGS. 5*a*, 6*a* and 7*a* are longitudinal sectional views. FIGS. 5*b*, 6*b* and 7*b* are cross-sectional views of the support element in the undeformed state and FIGS. 5*c*, 6*c* and 7*c* are cross-sectional views of the support element in the deformed state.

In the embodiment shown in FIGS. 5*a*–5*c* with a ribbed reinforcing rod 23 as the steel tension member 3, a continuous sheet metal tube 24 with profilings 25 and openings 26 is arranged within the plastics material tube 4. For example, a known wound ribbed tube can be used for this purpose, wherein the ribs, in a similar manner as the spiral 22, ensure a minimum distance d from the inner wall of the plastics material tube 4. The inner sheet metal tube 24 must have the openings 26 in order to enable the hardening material to enter the space between the sheet metal tube 24 and the inner wall of the plastics material tube 4 and to fill out this space.

In the embodiment according to FIGS. 6*a*–6*c*, in which the steel tension member 3 is composed of a bundle of steel wire strands 20, steel rings 27 are slid onto the plastics material tube 4 at the locations at which the deformations produced by transverse pressure are to be provided. The steel rings 27 fix or maintain these deformations. The steel rings 27 must be dimensioned in such a way that they can be deformed by transverse pressure and maintain the shape obtained in this manner against the restoring forces of the plastics material tube 4. It has been found that good results are obtained with steel rings whose thickness is approximately 4 to 8% and whose width is approximately 35 to 40% of their diameter.

Finally FIGS. 7*a*–7*c* show an embodiment, again with a reinforcing rod 23 as the steel tension member 3, in which a spiral 28 is incorporated into the wall of the plastics material tube 4. This provides the advantage that the casing tube or plastics material tube 4 has a smooth inner wall surface. However, it must be ensured that, when the deformations are subsequently produced, there is a sufficient distance between the inner wall of the casing tube 4 and the steel tension member 3, so that a sufficient cover with cement mortar filling out the remaining hollow space is ensured.

The invention is not limited by the embodiments described above which are presented as examples only but can be modified in various ways within the scope of protection defined by the appended patent claims.

We claim:

1. A corrosion-protected support element for a soil anchor, a rock anchor, or a pressure pile to be mounted in a bore hole, the support element comprising a support member comprising at least one individual element, a tubular casing surrounding the support member at least over a portion of the length of the support member for protecting against corrosion, a hollow space being defined between the support member and the tubular casing, a first hardening material being filled into the hollow space between the support member and the tubular casing, the support member being mounted in force-transmitting connection with the bore hole along a force-transmitting region extending over at least a portion of the length of the support member by a second hardening material filled into the bore hole, the tubular casing comprising a plastics material tube having an original uniform cross-section over the entire length thereof, wherein, at least in the force-transmitting region, the uniform original cross-section of the plastics material tube is deformed at spaced-apart locations to deviating cross-sections having different transverse extensions, wherein the deformations have an essentially oval cross-section.

2. The support element according to claim 1, wherein the first and second hardening materials are cement mortar.

3. The support element according to claim 1, wherein the tubular casing extends over the entire length of the support member.

4. The support element according to claim 1, wherein the plastics material tube is of polyethylene.

5. The support element according to claim 1, wherein the locations are spaced apart at uniform distances.

6. The support element according to claim 1, wherein the force-transmitting region has areas of high-force transmission and areas of low-force transmission, wherein the deformations are spaced closer together in the areas of high-force transmission than in the areas of low-force transmission.

7. The support element according to claim 1, wherein the oval cross-section has a large diameter and a small diameter, and wherein the original cross-section is circular having a diameter, the small diameter of the oval cross-section being approximately 80–90% of the diameter of the original circular cross-section.

8. The support element according to claim 1, wherein the deformations at successive locations are offset relative to each other by 90° about the longitudinal axis of the support element.

9. The support element according to claim 1, wherein the deformations at successive locations are continuously offset relative to each other by 60° about the longitudinal axis of the support element.

10. The support element according to claim 1, comprising plastically permanently deformable structural components provided at the locations of the deformations for fixing the deformations, the structural components being in positive engagement with the plastics material tube over the circumference thereof and being deformable therewith.

11. The support element according to claim 10, wherein the plastically deformable structural component is a spiral of steel wire extending at least over the length of the force-transmitting region.

12. The support element according to claim 11, wherein the spiral is arranged within the plastics material tube.

13. The support element according to claim 10, wherein the plastically deformable structural component is an inner sheathing tube of metal arranged within the plastics material tube and extending at least over the length of the force-transmitting region, the sheathing tube of metal having profilings facing and spaced apart from an inner wall of the plastics material tube and defining openings.

14. The support element according to claim 10, wherein the plastically deformable structural components are rings of steel mounted on the plastics material tube.

15. The support element according to claim 14, wherein the rings have a diameter, and wherein the rings have a thickness of approximately 4 to 8% and a width of approximately 35 to 50% of the diameter.

* * * * *